United States Patent [19]

Dickson et al.

[11] Patent Number: 4,945,993

[45] Date of Patent: Aug. 7, 1990

[54] SURFACE CONTROLLED SUBSURFACE SAFETY VALVE

[75] Inventors: Rennie L. Dickson, Carrollton; Roddie R. Smith, Plano, both of Tex.

[73] Assignee: Otis Engineering Corporation, Dallas, Tex.

[21] Appl. No.: 354,373

[22] Filed: May 19, 1989

Related U.S. Application Data

[63] Continuation of Ser. No. 191,185, May 6, 1988, abandoned.

[51] Int. Cl.[5] ..... E21B 34/10

[52] U.S. Cl. ..... 166/321; 166/332; 251/63.4

[58] Field of Search ..... 166/321, 319, 332, 72; 251/63.4, 63.5, 63.6, 62

[56] References Cited

U.S. PATENT DOCUMENTS

| | | | |
|---|---|---|---|
| 2,780,290 | 2/1957 | Natho | 166/72 |
| 2,798,561 | 7/1957 | True | 166/224 |
| 2,992,019 | 7/1961 | McArthur | 285/110 |
| 3,860,066 | 1/1975 | Pearce et al. | 116/72 |
| 3,882,935 | 5/1975 | Calhoun | 166/224 |
| 4,049,052 | 9/1977 | Arendt | 166/183 |
| 4,161,219 | 7/1979 | Pringle | 166/324 |
| 4,252,197 | 2/1981 | Pringle | 166/322 |
| 4,325,431 | 4/1982 | Akkerman | 166/117.5 |
| 4,344,602 | 8/1982 | Arnedt | 251/58 |
| 4,356,867 | 11/1982 | Carmody | 166/373 |
| 4,373,587 | 2/1983 | Pringle | 166/324 |
| 4,378,931 | 4/1983 | Adams, Jr. | 251/58 |
| 4,407,363 | 10/1983 | Akkerman | 166/183 |
| 4,434,847 | 3/1984 | Vazquez et al. | 166/117.5 |
| 4,444,266 | 4/1984 | Pringle | 166/324 |
| 4,449,587 | 5/1984 | Rodenberger et al. | 166/323 |
| 4,452,310 | 6/1984 | Pringle et al. | 166/319 |
| 4,467,870 | 8/1984 | Langham | 166/321 |
| 4,475,598 | 10/1984 | Brakhage, Jr. et al. | 166/321 |
| 4,495,998 | 1/1985 | Pringle | 166/321 |
| 4,503,913 | 3/1985 | Carmody | 166/319 |
| 4,527,630 | 7/1985 | Pringle | 166/321 |
| 4,569,397 | 2/1986 | Brakhage, Jr. et al. | 166/321 |
| 4,569,398 | 2/1986 | Pringle | 166/321 |
| 4,583,596 | 4/1986 | Davis | 166/332 |
| 4,597,445 | 7/1986 | Knox | 166/319 |
| 4,601,341 | 7/1986 | Pringle et al. | 166/321 |
| 4,621,695 | 11/1986 | Pringle | 166/321 |
| 4,669,547 | 6/1987 | Pringle | 166/321 |
| 4,691,776 | 9/1987 | Pringle | 166/319 |
| 4,703,805 | 11/1987 | Morris | 166/324 |
| 4,709,762 | 12/1987 | Pringle | 166/324 |
| 4,716,969 | 1/1988 | Pringle | 166/321 |
| 4,723,606 | 2/1988 | Vinzant et al. | 166/319 |
| 4,749,043 | 6/1988 | Rodenberger | 166/321 |
| 4,834,183 | 5/1989 | Vinzant et al. | 166/332 |

OTHER PUBLICATIONS

Otis Drawing 7800121.

*Primary Examiner*—Hoang C. Dang
*Attorney, Agent, or Firm*—Thomas R. Felger

[57] ABSTRACT

A surface controlled subsurface safety valve for use in a well tubing string including a valve closure member, an operator tube for opening the valve closure member, a small diameter offset piston to move the operator tube in response to control fluid pressure conducted from the well surface, and a spring biasing the operator tube to a position closing the valve. A bearing assembly mounted on the operator tube minimizes eccentric and torsional loading of the operator tube by the piston and spring. The operator tube also has multiple flow paths and barriers to prevent accumulation of debris from well fluids within the safety valve. The safety valve has metal-to-metal sealing systems to improve valve life under harsh downhole well environments.

14 Claims, 5 Drawing Sheets

SURFACE CONTROLLED SUBSURFACE SAFETY VALVE

This application is a continuation of copending patent application serial number 07/191,185 filed May 6, 1988, now abandoned.

BACKGROUND OF THE INVENTION

This invention relates to surface controlled subsurface safety valves used in the oil and gas industry and particularly to hydraulically operated valves with small piston areas and metal-to-metal seal systems.

DESCRIPTION OF RELATED ART

It is common practice to complete oil and gas producing wells with safety systems including a subsurface safety valve controlled from the well surface to shut off fluid flow in the well tubing string. Generally, such a valve is controlled in response to fluid pressure conducted to the valve from a remote location at the well surface via a small diameter conduit (control line) permitting the well to be selectively shut in as well conditions require. The surface controller is typically equipped to respond to emergency conditions such as fire, broken flow lines, oil spills, etc. Frequently, it is necessary to conduct well servicing operations througb a subsurface safety valve. The well servicing operation may require extending a wireline tool string through the subsurface safety valve. Examples of such services are pressure and temperature testing. Additional well servicing procedures are required to retrieve damaged downhole equipment. These procedures result in periodic opening and closing of the safety valve. Subsurface safety valves are shown in the following U.S. Pat. Nos. 3,860,066; 3,882,935; 4,344,602; 4,356,867; and 4,449,587. The present invention is shown with a flapper type valve closure in the subsurface safety valve. U. S. Pat. No. 3,860,066 teaches that a longitudinally movable operator tube may control the opening and closing of ball, poppet, or flapper type valve closure means within a subsurface safety valve.

For some well completions, it is desirable to install the safety valve at deep depths. For these completions a small piston area is one way to minimize the effect of hydrostatic fluid pressure from the control line leading to the well surface. Pistons having a small cross section in comparison to the cross section of the complete valve assembly have been used in surface controlled subsurface safety valves (SCSSV). Examples of such pistons are shown in:

| U.S. PAT. No. | TITLE |
|---|---|
| 2,780,290 | Surface Controlled Subsurface Tubing Pressure Shut-Off Valve |
| 2,798,561 | Blowout Preventer for Wells |
| 4,049,052 | Subsurface Annulus Safety Valve |
| 4,161,219 | Piston Actuated Well Safety Valve |
| 4,444,266 | Deep Set Piston Actuated Well Safety Valve |

U.S. Pat. No. 4,378,931 teaches a surface controlled subsurface safety valve which is operated by a reciprocating hydraulic motor or piston mounted on the exterior of the safety valve housing.

Since a tubing retrievable safety valve cannot be easily removed from the well bore for routine maintenance, any failure of a fluid seal or accumulation of debris within the safety valve can be very expensive to correct. All sealing systems are subject to failure depending upon the operating environment and design of the seals. For some environments metal-to-metal seals produce longer life as compared to elastomeric materials. Elastomeric, polymeric, and metal-to-metal seal systems have been used in SCSSV's. Examples of metal-to-metal seal systems are shown in:

| U.S. PAT. No. | TITLE |
|---|---|
| 4,452,310 | Metal-to-Metal High/Low Pressure Seal |
| 4,467,870 | Fluid Pressure Actuator for Subterranean Well Apparatus |
| 4,475,598 | Ball Value Actuating Mechanism |
| 4,527,630 | Hydraulic Actuating Means for Subsurface Safety Valve |
| 4,583,596 | Dual Metal Seal for a Well Safety Valve |

Copending U.S. patent application Ser. No. 07/155,980 filed on Feb. 16, 1988, now U.S. Pat. No. 4,834,183, is directed towards solving problems associated with accumulation of sand or other debris in a safety valve. U.S. Pat. No. 4,723,606 teaches an operator tube and a valve closure means which can be cycled open and closed with a wireline tool. The present invention incorporates features shown in U.S. Pat. No. 4,834,183 and U.S. Pat. No. 4,723,606.

The previously listed patents are incorporated by reference for all purposes in this application.

SUMMARY OF THE INVENTION

The present invention relates primarily to tubing retrievable safety valves having a housing connectable with a well tubing string and a bore therethrough for communicating well fluid flow with the tubing string, a valve closure means mounted in the housing for movement between a first open position and a second closed position, and an operator tube in the housing to control movement of the valve closure means between its first position and its second position. The operator tube normally moves in response to control fluid pressure acting on a small diameter piston and a spring biasing the operator tube to move in opposition to the piston.

The present invention allows for the use of metal-to-metal seals as desired to accommodate downhole well conditions. Also, the present invention minimizes the possibility of debris accumulation and allows for movement of the operator tube by a wireline tool if it should become stuck. The net result is a subsurface safety valve with increased downhole service life even though the well fluids flowing therethrough may be harmful to the sealing system or may contain sand, paraffin, calcium, or other materials.

The outside diameter of the operator tube is smaller than the inside diameter of the housing means adjacent thereto. This difference in diameters allows the operator tube to slide longitudinally within the housing means. The difference in diameters creates an annular space which has a tendency to accumulate sand or other debris carried by well fluids. If such deposits are allowed to accumulate in the annular space, they may prevent satisfactory functioning of the safety valve.

It is a principal object of the present invention to provide a subsurface safety valve for use at greater depths in oil and gas wells which minimizes the possibility for sand or other debris to hinder proper functioning of the safety valve.

It is another object of the invention to provide a subsurface safety valve having an operator tube and improved piston means which minimizes the number of potential fluid leakage paths. The present invention has one metal-to-metal seal which blocks well fluids from entering the control line when the safety valve is in its closed position.

It is a further object of the invention to provide a subsurface safety valve having an operator tube and piston means with a metal-to-metal seal system.

It is another object of the invention to provide a subsurface safety valve having an operator tube with a single, small diameter piston means offset from the longitudinal axis of the operator tube. A bearing assembly and a flexible coupling between portions of the operator tube are provided to minimize eccentric loading.

It is a further object of the invention to provide a subsurface safety valve including flow channels between the operator tube and valve housing to flush sand or other debris which might hinder movement of the operator tube.

It is an object of the invention to provide an operator tube and valve closure means which can be opened and closed with a wireline tool.

Additional objects and advantages of the present invention will be apparent to those skilled in the art from studying the following detailed description in conJunction with the accompanying drawings in which several preferred embodiments of the invention are shown.

DESCRIPTION OF THE PREFERRED EMBODIMENT

Figure 1:
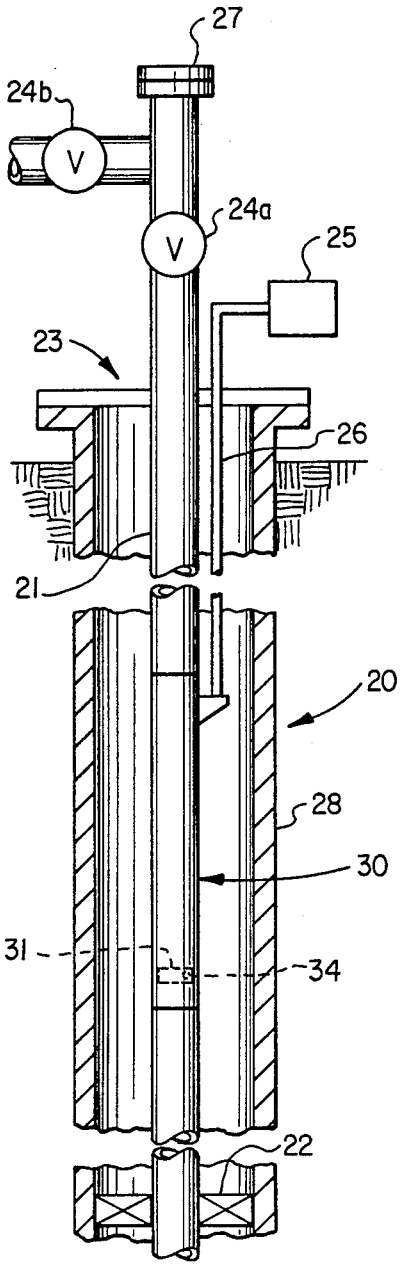
FIG. 1 is a schematic view in section and elevation of a typical well completion including a tubing retrievable subsurface safety valve with a flapper type valve closure means.

In the following description, like parts are designed throughout the specification and drawings with the same reference numerals. The drawings are not necessarily to scale. Portions of some parts have been exaggerated to better illustrate details of the present invention.

Referring to FIG. 1, well completion 20 includes casing string 28 extending from the well surface to a hydrocarbon producing formation (not shown). Tubing string 21 is concentrically disposed within casing 28 and extends from wellhead 23 through production packer 22 which seals between tubing string 21 and casing 28. Packer 22 directs formation fluids such as oil, gas, water, and the like into tubing string 21 from perforations (not shown) in casing 28 which admit formation or well fluids into the well bore. Well fluids frequently carry sand or other debris which may accumulate at locations in tubing string 21 having low fluid velocity. Flow control valves **24*a* and 24*b* at the well surface control fluid flow from tubing string 21. Wellhead cap 27 is provided on wellhead 23 to permit servicing well 20 via tubing string 21 by wireline techniques which include the installation and removal of various downhole tools (not shown) within tubing string 21. Other well servicing operations which may be carried out through tubing string 21** are bottom hole temperature and pressure surveys.

Surface controlled subsurface safety valve 30 embodying the features of the invention is installed in well completion 20 as a part of tubing string 21 to control fluid flow to the well surface via tubing string 21 from a downhole location. Safety valve 30 is operated by control fluid conducted from hydraulic manifold 25 at the well surface via control line conduit 26 which directs the control fluid signal to safety valve 30. Hydraulic manifold 25 generally includes pumps, a fluid reservoir, accumulators, and control valves for the purpose of providing control fluid pressure signals for holding valve 30 open or allowing valve 30 to close when desired. Manifold 25 also includes apparatus which functions in response to temperature, surface line leaks, and other emergency conditions under which well 20 should be shut in.

Figure 2A:
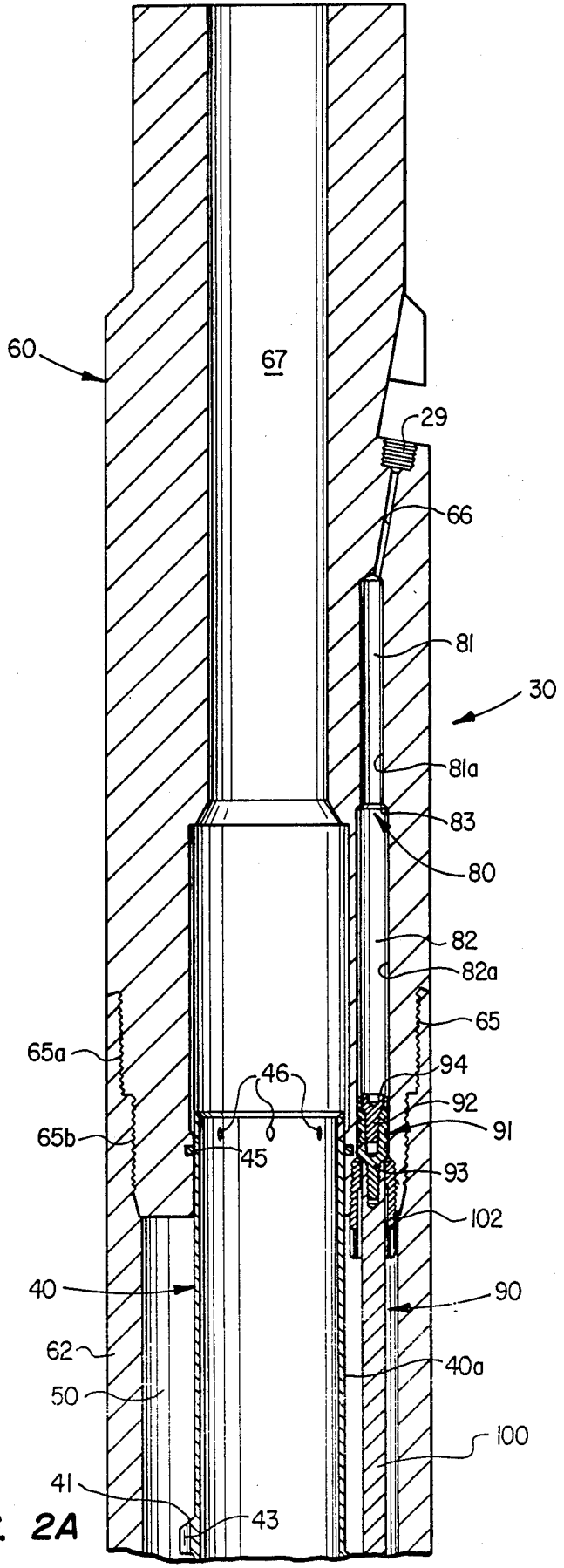
FIGS. 2A and 2B taken together form a longitudinal view in section with portions broken away of a subsurface safety valve and operator tube incorporating the present invention showing the safety valve in its open position.
Figure 2B:
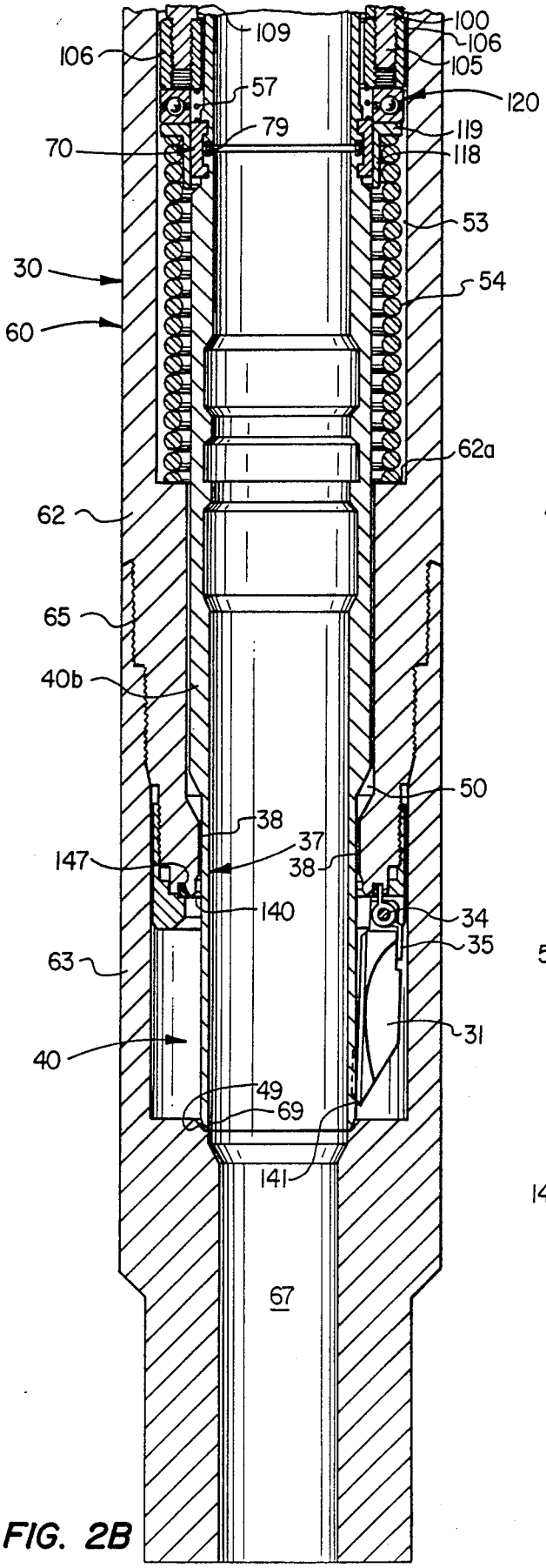

Safety valve 30 includes flapper type valve closure means 31 mounted on hinge 34 for swinging between its closed position schematically represented in FIG. 1 and its open position in FIG. 2B which permits fluid flow through tubing string 21. When a predetermined pressure signal is applied to safety valve 30 through control line 26 from manifold 25, valve closure means or flapper 31 is maintained in its first or open position. When the control pressure signal is released, valve 30 is allowed to move to its second or closed position.

Details for construction of the preferred form of valve 30 are shown in FIGS. 2A and 2B. Subsurface safety valve 30 has housing means 60 formed by housing subassemblies 61, 62, and 63 which are suitably interconnected by threaded joints 65. Subassemblies 61, 62, and 63 could be interconnected by welded joints or by a combination of threads and elastomeric seals. Welding is sometimes unsatisfactory due to requirements for heat treating before and after. Elastomeric seals in some environments (high pressure, high temperature gas) have a tendency to fail during pressure transients. Threaded joints 65 are preferred because they have mechanical strength comparable to a welded connection and a metal-to-metal seal. U.S. Pat. No. 2,992,019 discloses threads and a metal-to-metal seal system similar to threaded joint 65.

Threaded joint 65 is sometimes referred to as a two-step thread because the diameter of threaded portion 65*a* is substantially larger than threaded portion 65*b*. Depending upon the type of materials used to manufacture housing means 60, diameter 65*b* and the length of threaded portions 65*a* and 65*b* may be increased or decreased so that threaded joint 65 has mechanical strength equal to or greater than any other portion of housing means 60. Threaded joint 65 is particularly desirable because it allows many alternatives with respect to designing housing means 60 but is relatively easy to manufacture and assemble.

Housing means 60 can be generally described as a long thick walled cylinder with longitudinal bore 67 extending therethrough. The ends of housing subassemblies 61 and 63 may be internally or externally threaded to provide means on opposite ends of housing means 60 for connection with tubing string 21. A lockout sleeve (not shown) could be incorporated into safety valve 30 if desired to hold valve closure means 31 open. Lockout sleeves which can be shifted by wireline tools to permanently or temporarily hold valve closure means 31 open are known in the art.

Housing subassembly 61 has threaded connection 29 to attach control line 26 to safety valve 30. Control fluid pressure signals are communicated from the well surface via control line 26, threaded connection 29, drilled passageway 66, and offset passageway 80. Passageway 80 is machined in the wall of housing subassembly 61 parallel with but offset from longitudinal bore 67. Passageway 80 has two portions—upper chamber 81 and piston chamber 82. Inside diameter 81*a* of upper chamber 81 is smaller than inside diameter 82*a* of piston chamber 82. This change in diameters creates seating surface 83 therebetween. Both inside diameter 81*a* and 82*a* are substantially smaller than the inside diameter of longitudinal bore 67 adjacent thereto.

Figure 3:
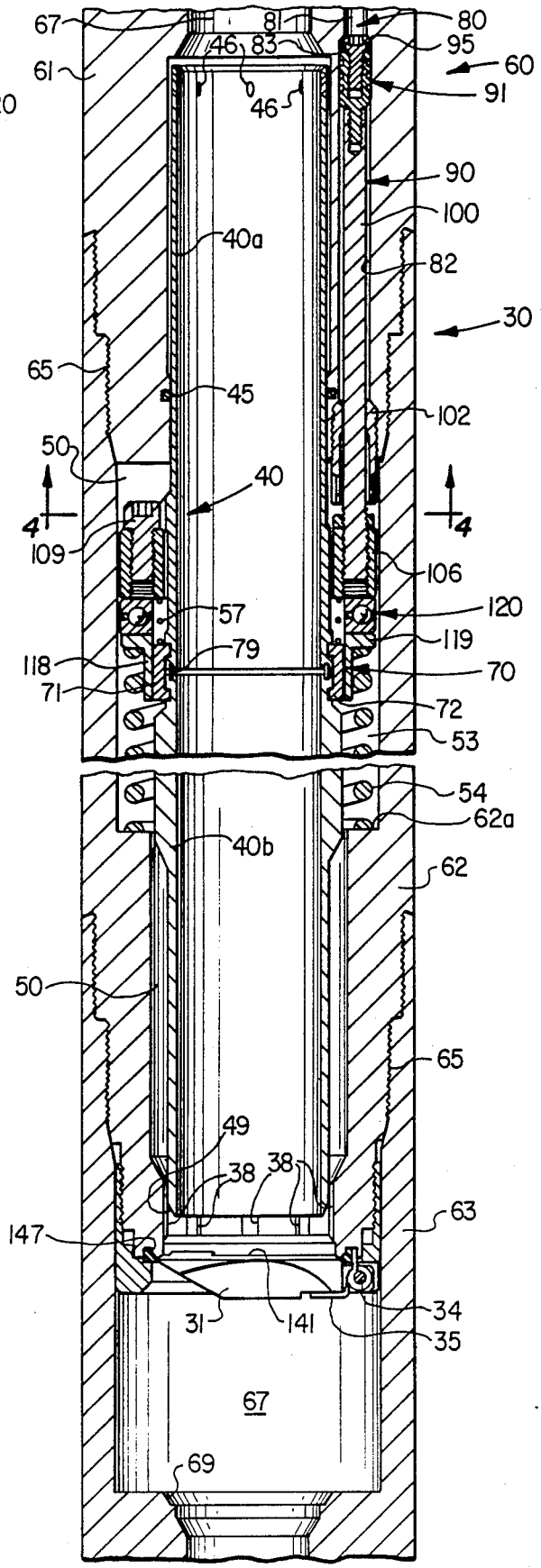
FIG. 3 is a drawing in longitudinal section with portions broken away of the subsurface safety valve shown in FIGS. 2A and 2B in its closed position.

Operator tube 40 is slidably disposed within longitudinal bore 67 to shift valve closure means 31 from its second, closed position as shown in FIG. 3 to its first, open position as shown in FIG. 2B. Operator tube 40 is constructed from two or more generally hollow, cylindrical sections designated 40*a* and 40*b*. Sections 40*a* and 40*b* are joined together by flexible coupling means 70. Piston means 90, disposed in housing means 60 offset from longitudinal bore 67, moves operator tube 40 in response to control fluid pressure from the well surface. A portion of piston means 90 is slidably disposed in offset passageway 80.

Figure 5:
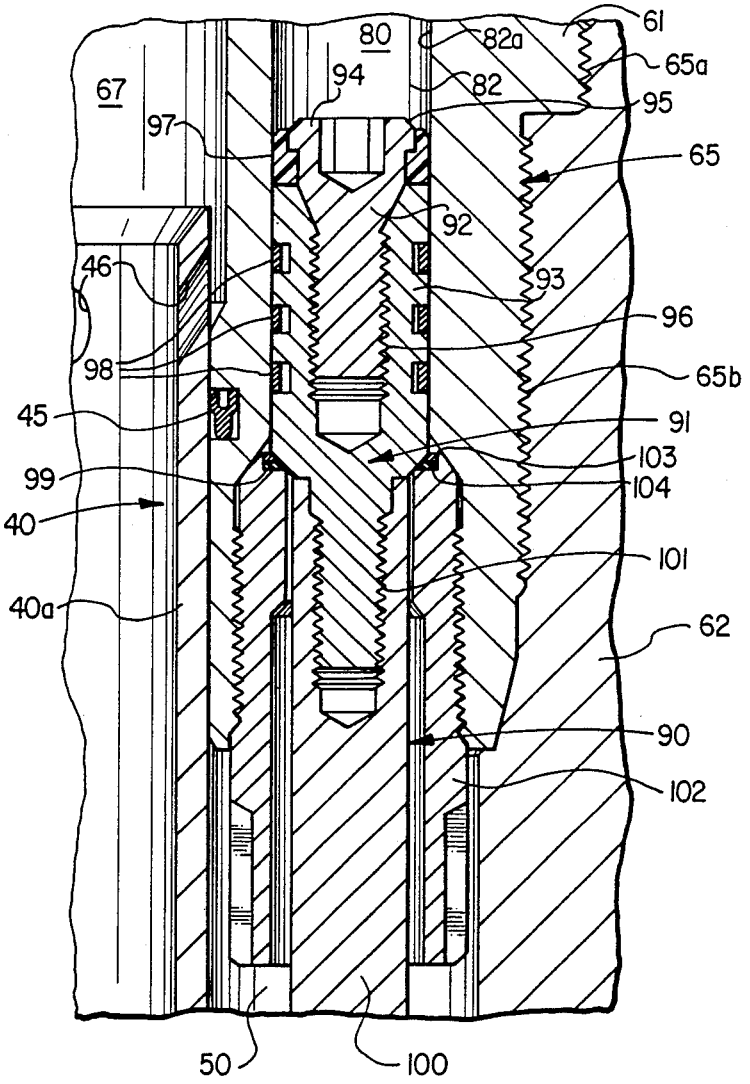
FIG. 5 is an enlarged view in section with portions broken away showing improved piston means offset from the operator tube.
Figure 4:
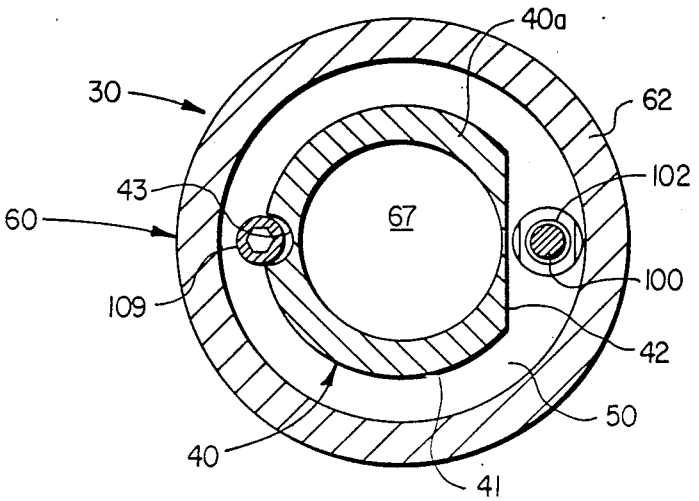
FIG. 4 is a drawing in section taken along line 4—4 of FIG. 3.
Figure 6:
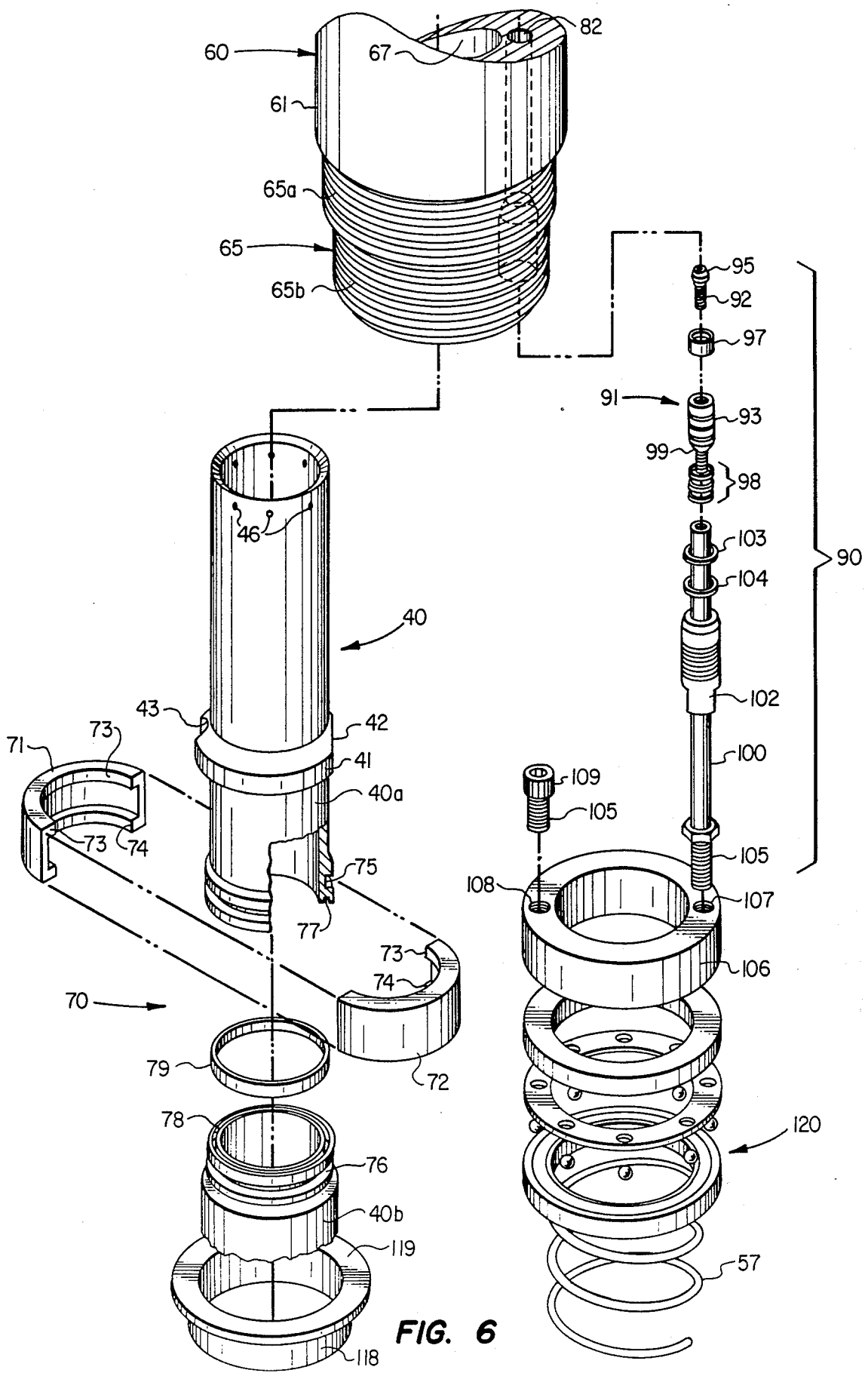
FIG. 6 is an exploded orthographic projection of the components of the piston means, the bearing assembly, and flexible coupling.
Figure 10:
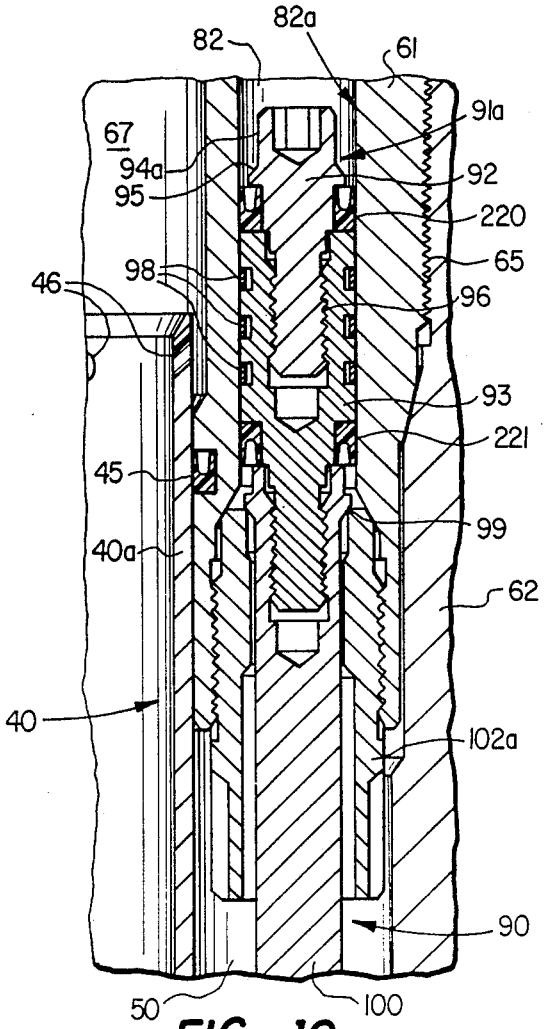
FIG. 10 is a drawing in section with portions broken away showing an alternative piston means as compared to FIG. 5.

Piston means 90 has two main components—seal assembly 91 and cylindrical rod 100. Other components of piston means 90 are shown in FIG. 5, 6 and 10. Seal assembly 91 includes seat insert 92 and piston ring carrier 93. Seat insert 92 is similar to a machined bolt. Head 94 of insert 92 has metal seating surface 95 machined thereon to mate with seating surface 83 of offset passageway 80. Insert 92 is attached to piston ring carrier 93 by threads 96. Preferably, resilient seal ring 97 is disposed between head 94 and carrier 93. Resilient seal ring 97 functions as a backup for metal-tometal seating surfaces 83 and 95.

The configuration of seal assembly 91 within offset passageway 80 results in only one possible leak path for well fluids to enter control line 26 when safety valve 30 is closed. This leak path is blocked by engagement of metal-tometal seating surfaces 83 and 95 when safety valve 30 is closed as shown in FIG. 3. Spring 54 assists in maintaining this metal-to-metal seal when there is only a small difference between control fluid pressure and well fluid pressure. NOTE: Well fluid pressure would only be present at seating surfaces 83 and 95 if valve closure means 31 was also leaking. Normally, valve closure means 31 blocks well fluid flow when safety valve 30 is in its closed position.

Three piston rings 98 are disposed in separate grooves on the exterior of carrier 93. Piston rings 98 are sized to fit snugly within inside diameter 82*a* and substantially limit fluid flow past seal assembly 91. Metal seating surface 99 is provided on the end of carrier 93 opposite from head 94. Seal assembly 91 is attached to the upper end of rod 100 by threads 101. Therefore, seal assembly 91 and rod 100 move as a single unit in response to control fluid pressure in piston chamber 82. Metal seating surface 99 may be provided on rod 100 as shown in the alternative embodiment of FIG. 10.

The exterior of operator tube 40 and the interior of housing subassembly 62 partially defines annulus 50 therebetween. Piston rod 100 extends from the lower end of housing subassembly 61 into annulus 50. During assembly of safety valve 30, seat insert 92 is engaged with piston ring carrier 93 to form seal assembly 91. Cylindrical rod 100 and seal assembly 91 are then threaded together to form piston means 90 and partially disposed within offset passageway 80 of housing subassembly 61. Metal seat insert 102 is sized to slide over rod 100 and thread into piston chamber 82 at its exit from the lower end of housing subassembly 61. Piston rod 100 is sized to slide longitudinally through metal seat insert 102. However, seal assembly 91 is too large to move therethrough. One function of metal seat insert 102 is to retain seal assembly 91 within piston chamber 82. Resilient seal ring 104 and retainer ring 103 are preferably disposed on the end of insert 102 within chamber 82. Resilient seal ring 104 is sized to engage metal seating surface 99 of seal assembly 91 and to form a fluid barrier therewith. Resilient seal ring 104 is installed to provide a backup for metal-to-metal seals 99.

Flange 41 is machined on the exterior of operator tube 40 to fit within annulus 50. Flange 41 has a generally circular cross section except for flat 42 and notch 43 milled on opposite sides therefor. Flat 42 provides clearance for piston rod 100 to extend through annulus 50 past flange 11. The lower end of piston rod 100 is engaged with load ring 106 which is sized to fit around the exterior of operator tube 40 within annulus 50. Load ring 106 has threaded holes 107 and 108 diametrically opposite from each other. Hole 107 is provided to receive threads 105 of piston rod 100. Hole 108 is provided to receive alignment pin 109 having similar threads 105. Alignment pin 109 is sized to fit within notch 43. Pin 109 and notch 43 cooperate to prevent rotation of load ring 106 relative to operator tube 40. Piston means 90 can apply forces to load ring 106 which are transferred to operator tube 40 to open valve closure means 31. An opposing force is applied to load ring 106 by biasing means or spring 54 to move operator tube 40 and allow valve closure means 31 to move to its closed position. Load ring 106 is also disposed between flange (first shoulder) 41 and coupling means (second shoulder) 70 on the exterior of operator tube 40.

Biasing means or spring 54 is carried on the exterior of operator tube 40 in spring chamber 53 which is a portion of annulus 50. Spring chamber 53 is defined in part by shoulder 62*a* and the inside diameter of housing subassembly 62. Biasing means 54 applies a force to slide operator tube 40 longitudinally opposite from the force of control fluid pressure in piston chamber 82 acting on piston means 90. When control fluid pressure in chamber 82 is decreased below a preselected value, spring 54 moves operator tube 40 longitudinally upward to allow valve closure means 31 to return to its second, closed position. Spring 35 coiled around hinge 34 assists in moving flapper 31 to its closed position.

Operator tube 40 could be designed to allow spring 54 to directly contact a shoulder on its exterior. Such design is frequently used in commercially available subsurface safety valves. Compression of spring 54 (FIG. 2B) and expansion of spring 54 (FIG. 3) produces torsional forces in addition to longitudinal forces. Therefore, bearing assembly 120 is disposed on the exterior of operator tube 40 between load ring 106 and spring 54. Bearing assembly 120 isolates torsional forces generated by spring 54 from operator tube 40 and piston means 90.

Longitudinal force from spring 54 is transmitted via bearing assembly 120 to load ring 106 and then to first shoulder (flange) 41 on the exterior of operator tube 40. Longitudinal force from piston means 90 is transmitted via load ring 106 and small spring 57 to second shoulder (flexible coupling) 70 on the exterior of operator tube 40.

Longitudinal force to shift valve closure means 31 to its open position is initiated by supplying a preselected amount of control fluid pressure to piston chamber 82. Piston means 90 converts control fluid pressure to a longitudinal force which is transferred via rod 100 to load ring 106. A small spring 57 is positioned between flexible coupling means 70 and load ring 106. Longitudinal force on load ring 106 via small spring 57 is transferred to flexible coupling means 70. Since flexible coupling means 70 is an integral portion of operator tube 40, the longitudinal force will move operator tube 40 to open valve closure means 31.

Figure 9:
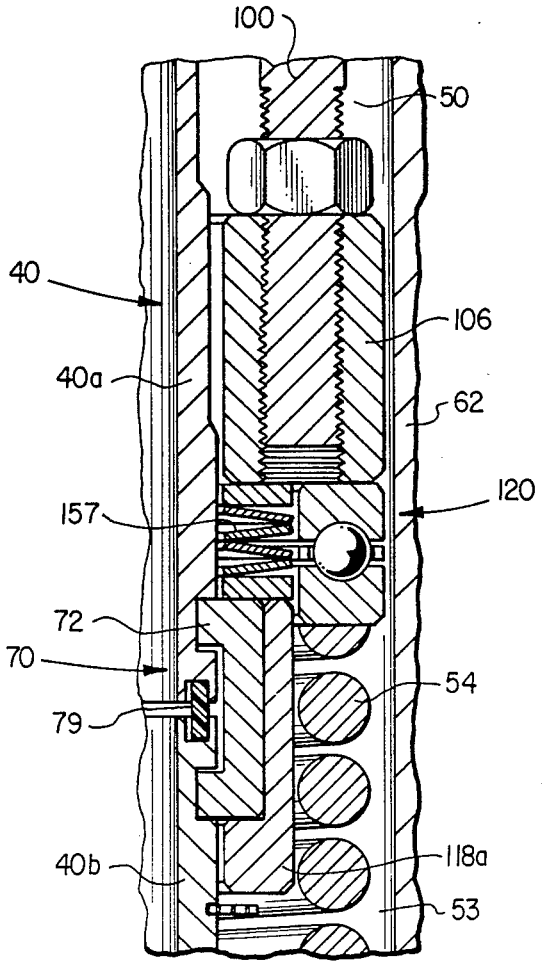
FIG. 9 is an enlarged drawing in section with portions broken away showing an enlarged view of the flexible coupling and bearing assembly with an alternative small spring.

At the same time as load ring 106 is applying longitudinal force to flexible coupling means 70, longitudinal force is also being applied to spring 54 via bearing assembly 120 and flange 119. Keeper sleeve 118 is generally cylindrical and sized to fit around operator tube 40 and flexible coupling means 70. Flange 119 on the exterior of keeper sleeve 118 provides a rest for bearing assembly 120. Spring 54 contacts the bottom of flange 119 and bearing assembly 120 the top. Thus, torsional forces from compressing spring 51 are isolated from piston means 90. An alternative design, keeper sleeve 118*a*, is shown in FIG. 9.

Longitudinal force to shift operator tube 40 in the opposite direction to allow valve closure means 31 to move to its closed position is supplied primarily by biasing means or spring 54. First control fluid pressure in piston chamber 82 is decreased below a preselected value. Spring 54 can then expand. Longitudinal force from expansion of spring 54 is applied to operator tube 40 via flange 119, bearing assembly 120, and load ring 106. During expansion of spring 54, load ring 106 contacts the bottom of flange 41 to return operator tube 40 to its second position. Bearing assembly 120 isolates operator tube 40 and piston means 90 from torsional forces generated by expansion of spring 54.

Stationary scraper seal 45 is carried on the interior of housing subassembly 61 near the upper end of operator tube 40. Stationary seal 45 acts as a scraper or trash barrier to prevent sand or other debris from entering annulus 50.

If desired, operator tube 40 could be machined from a single piece of raw material or sections 40*a* and 40*b* joined together by threads. However, such construction requires adherence to many close tolerances for proper functioning of operator tube 40 within longitudinal bore 67. Also during slam closure of flapper 31, operator tube 40 may be damaged by high stress loading. Operator tube 40 as shown in FIGS. 2A and 2B compensates for variations in manufacturing tolerances and provides for easier assembly by using flexible coupling or connecting means 70. Flexible coupling 70 also compensates for slam closure forces. As best shown in FIG. 6, flexible coupling 70 comprises two split rings 71 and 72. Each split ring 71 and 72 has a pair of inwardly facing flanges 73 and 74 that engage matching grooves 75 and 76 on operator tube sections 40*a* and 40*b* respectively. Recesses 77 and 78 are machined into the end of sections 40*a* and 40*b* respectively facing each other. Sand barrier ring 79 fits within recesses 77 and 78 between sections 40*a* and 40*b*. During assembly, ring 79 is inserted into recess 77. Section 40*b* is then positioned adjacent to and aligned with section 40*a* with ring 79 partially disposed in recess 78. Split rings 71 and 72 are next engaged with grooves 75 and 76. Split rings 71 and 72 cause operating tube sections 40*a* and 40*b* to move together in unison within longitudinal bore 67 while allowing limited flexing to compensate for minor variations in dimensional tolerances between operator tube 40 and the interior of housing means 60. During slam closure, section 40*b* can be axially displaced a limited amount without transferring this force to section 40*a*or piston means 90. Keeper sleeve 118 is sized to slide over the exterior of operator tube section 40*b* and to securely engage split rings 71 and 72 with each other. Sand barrier ring 79 restricts fluid flow between the adjacent ends of sections 40*a* and 40*b*. Ring 79 can be manufactured from a wide variety of elastomers and copolymers. Teflon based material has proven satisfactory for ring 79.

For ease of manufacture and assembly, valve seat 37 is machined as part of housing subassembly 62 within longitudinal bore 67. Valve seat 37 could be manufactured as a separate component and inserted into housing subassembly 62. Valve seat 37 as shown in FIGS. 2B and 3 has a circular cross section. Valve seat 37 has a hardened surface 140 to form a metal-tometal fluid seal with matching surface 141. Copolymeric or resilient seal means 147 is carried by valve seat 37 to provide a backup fluid seal when valve closure means 31 is in its second, closed position. An important feature of valve seat 37 is flow channels 38 machined on the inside diameter of housing subassembly 62. Hardened metal seating surfaces 140 and 141 are particularly desirable when valve closure means 31 is subjected to slam closure. Resilient seal means 147 is particularly beneficial for providing a fluid tight barrier at low pressures.

Sand or Debris Control

Sand or other debris, contained in the well fluids, has a tendency to settle out or accumulate in areas of low fluid flow velocity. Examples of such areas are the top of operator tube 40 when safety valve 30 is open and spring chamber 53. A plurality of small ports or flow nozzles 46 extend through the upper end of operator tube 40. Flow nozzles 46 are machined at an acute angle relative to the longitudinal axis of operator tube 40 and are evenly spaced around the circumference thereof. A portion of the well fluids flowing through operator tube 40 will exit via flow nozzles 46 and create turbulent flow within housing means 60 adjacent thereto. Turbulent flow at this location tends to scour the inside diameter of housing means 60 and to prevent debris accumulation on top of scraper ring 45. The number, size, and acute angle associated with flow nozzles 46 can be varied to accommodate the internal dimensions of safety valve 30 and the characteristics of the well fluids flowing therethrough.

Another potential area to accumulate debris is annulus 50 between the inside diameter of housing means 60 and the outside diameter of operator tube 40. Coupling means 70 with ring 79 blocks well fluid flow between the ends of operator tube sections 40*a* and 40*b*. When safety valve 30 is in its full open position as shown in FIG. 2B, lower end 49 of operator tube 40 contacts tapered shoulder 69 to form a fluid barrier therewith. Spring 57 (FIGS. 2, 3, and 6) or alternative spring 157 (FIG. 9) is positioned between load ring 106 and coupling means (second shoulder) 70 on the exterior of operator tube 40. Spring 57 or 157 is used to protect lower end 49 of operator tube 40 and tapered shoulder 69 during slam opening of safety valve 30. They function as a lost motion device to allow limited movement of load ring 106 relative to operator tube 40. Spring 57 or 157 controls the amount of force with which lower end 49 contacts tapered shoulder 69. The amount of force is a significant factor in determining the sealing characteristics of this fluid barrier. Thus the present invention minimizes the entrance points for well fluids to carry debris into annulus 50.

Spring chamber 53 is generally filled with stagnate well fluid. During the opening and closing of valve closure means 31, spring 54 will expand and contract within spring chamber 53. This movement of spring 54 will result in some well fluid flow into and out of spring chamber 53. The lower portion of section 40*b* is substantially reduced as compared to the other portions of operator tube 40 and valve seat 37. Therefore, while operator tube 40 is moving valve closure means 31 from its closed position to its open position, well fluids and debris will be discharged from spring chamber 53 via flow channels 38. The dimensions for flow channels 38 are selected to provide mechanical support for the portion of operator tube 40 adjacent thereto during slam closure. Fluid will exit from spring chamber 53 when valve closure means 31 is intermediate its first and second position. The reduced diameter portion of section 40*b* also minimizes the possibility of operator tube 40 damaging valve seat 37 during slam closure of flapper 31.

Alternative Embodiments

The previous description has been directed towards an operator tube which opens a flapper type valve closure means. U.S. Pat. No. 3,860,066 to Joseph L. Pearce et al demonstrates that operator tube 40 could be modified to open and close ball type and poppet type valve closure means in addition to flapper 31. Therefore, the present invention is not limited to flapper valves.

Figure 7:
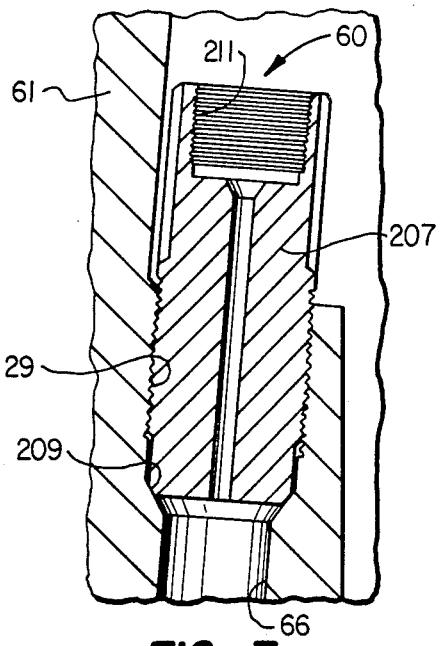
FIG. 7 is an enlarged drawing in section with portions broken away showing a first adapter to attach a control line conduit to the subsurface safety valve of FIG. 2A.
Figure 8:
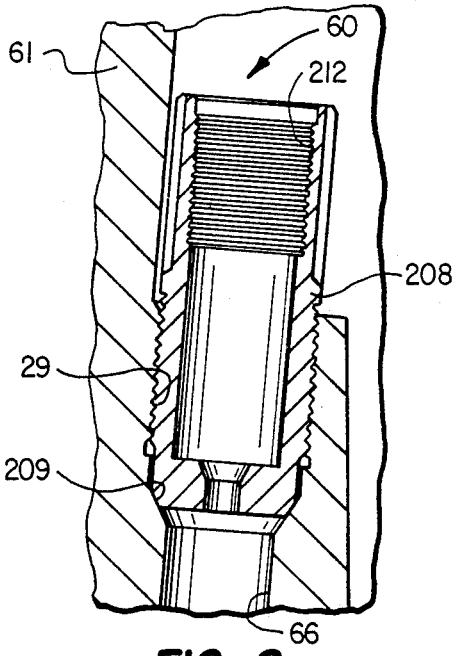
FIG. 8 is an enlarged drawing in section with portions broken away showing a second adapter to attach a control line conduit to the subsurface safety valve of FIG. 2A.

FIGS. 7 and 8 show alternative control line adapters 207 and 208 respectively which ma be used to attach control line 26 to housing means 60. Both adapters 207 and 208 have threads on their exterior for engagement with threaded connection 29 of housing subassembly 61. The lower portion of each adapter 207 and 208 forms metal-to-metal seal 209 with the interior of drilled passageway 66 to prevent control fluid leaks. Control line 26 may be secured within openings 211 or 212 by welding, brazing, fine pitch threads or a combination thereof. FIGS. 7 and 8 demonstrate the flexibility of the present invention to accommodate various adapters while maintaining fluid tight integrity with metal-to-metal seals such as 209.

An important feature of the present invention is the metal-to-metal seal established by seating surface 95 of seal assembly 91 contacting seating surface 83 of offset passageway 80 when safety valve 30 is in its second, closed position. See FIG. 3. FIG. 9 shows the use of heavy duty spring 157 between load ring 106 and flexible coupling means (second shoulder) 70 on the exterior of operator tube 40. Spring 157 comprises a plurality of belleville washers to exert additional force on operator tube 40 to help hold seating surfaces on lower end 49 and tapered shoulders 69 in fluid tight contact. Coupling means 70 of FIG. 9 shows a modified keeper sleeve 118*a*. Flange 119 has been eliminated as compared to keeper sleeve 118 of FIGS. 2B, 3, and 6. The configuration shown in FIG. 9 allows spring 54 to directly contact bearing assembly 120. Depending upon installation depth, well fluids (gas or liquid) and control line fluid, spring 157 and keeper sleeve 118*a* may offer improved performance as compared to spring 57 and keeper sleeve 118 with flange 119.

Many variations to seal assembly 91 of piston means 90 are made possible by the present invention. Seal assembly 91 can be easily modified to accommodate a wide variety of downhole environments. Spring loaded piston rings 98 are used to minimize galling with honed inside diameter 82*a*. Three piston rings 98 are shown in the drawings. This number may be increased or decreased as required in specific well conditions and control line fluids. Also, one or more metal piston rings 98 could be replaced by an elastomeric or polymeric seal ring. Ryton or Teflon based compounds may be used for some applications.

Seal assembly 91*a* of FIG. 10 shows the use of u-cup (Variseals) seals 220 and 221 on opposite ends thereof. U-cup seals 220 and 221 are similar in design and construction to scraper ring 45. In particularly harsh environments, they will assist with cleaning inside diameter 82*a* during movement of piston means 90. U-cup seals 220 and 221 may also function as a backup for metal-to-metal seating surfaces 95 and 99 in the same manner as previously described for resilient (Teflon) seal rings 97 and 104. The use of one or both u-cup seals is optional depending upon the well environment. U-cup seal 221 is helpful to prevent gas migration into control line 26 during travel of piston means 90 between the first open position and the second closed position.

For some downhole environments (high pressure gas wells), a complete fluid tight barrier between annulus 50 and longitudinal flow passageway 67 may subject operator tube 40 to excessive differential pressure. Various modifications to operator tube 40 and its associated seals are possible to allow pressure equalization if required. These modifications include placing one or more small notches (not shown) in lower end 49 or drilling one or more small holes (not shown) radially through the reduced diameter portion of section 40*b*. These modifications would be sized to prevent any substantial fluid flow into annulus 50.

The preceding written description explains only some embodiments of the present invention. Those skilled in the art will readily see other modifications and variations without departing from the scope of the invention which is defined by the claims.

What is claimed is:

1. A safety valve for downhole use in a well comprising:

a. housing means having a longitudinal bore extending therethrough;

b. valve closure means mounted in the housing means to control fluid flow through the longitudinal bore;

c. the valve closure means having a first position which allows fluid flow through the longitudinal bore and a second position which blocks fluid flow therethrough;

d. an operator tube in the housing means to shift the valve closure means from its second position to its first position;

e. piston means for moving the operator tube in response to control fluid pressure from the well surface;

f. the piston means disposed within the housing means offset from the longitudinal bore;

g. a bearing assembly carried on the exterior of the operator tube with a plurality of ball bearings disposed between an upper bearing race and a lower bearing race and its outside diameter compatible with the interior of the housing means and slidably disposed around the exterior of the operator tube; and h. the piston means engaging the bearing assembly to transmit force to the operator tube.

2. A safety valve for downhole use in a well comprising:

a. housing means having a longitudinal bore extending therethrough;

b. valve closure means mounted in the housing means to control fluid flow through the longitudinal bore;

c. the valve closure means having a first position which allows fluid flow through the longitudinal bore and a second position which blocks fluid flow therethrough;

d. an operator tube in the housing means to shift the valve closure means from its second position to its first position;

e. means for biasing the operator tube to its second position and the valve closure means to its second position;

f. piston means for moving the operator tube in response to control fluid pressure from the well surface;

g. the piston means disposed within the housing means offset from the longitudinal bore;

h. means for minimizing torsional loading of the piston means by the biasing means comprising a bearing assembly carried on the exterior of the operator tube;

i. the bearing assembly further comprising a plurality of ball bearings disposed between an upper bearing race and a lower bearing race; and j. the bearing assembly having an outside diameter compatible with the interior of the housing means and slidably disposed around the exterior of the operator tube.

3. The safety valve as defined in claim 2 wherein the piston means for moving the operator tube comprises:

a. a rod partially disposed within a passageway offset from the longitudinal bore;

b. a seal assembly secured to one end of the rod to form a slidable fluid barrier in the passageway;

c. seating surfaces at each end of the passageway to partially define limits for travel of the seal assembly therein; and d. matching seating surfaces on the seal assembly to form a fluid barrier with the passageway when the seal assembly has reached the limit of its travel in either direction.

4. The safety valve as defined in claim 3 wherein the seating surfaces form metal-to-metal seals when engaged with each other.

5. The safety valve as defined in claim 4 wherein the piston means further comprises a plurality of piston rings carried on the exterior of the seal assembly to form the slidable fluid barrier with the passageway.

6. A surface controlled subsurface tubing supported well safety valve comprising:

a. tubular housing means having a longitudinal bore therethrough and means on opposite ends for connecting the housing means in a well tubing string to form a portion thereof;

b. valve closure means mounted in the housing means to control fluid flow through the longitudinal bore;

c. the valve closure means having a first position which allows fluid flow through the longitudinal bore and a second position which blocks fluid flow therethrough;

d. an operator tube in the housing means to shift the valve closure means from its second position to its first position;

e. the operator tube having first and second positions which correspond respectively to the first and second positions for the valve closure means;

f. piston means for moving the operator tube and valve closure means to their first position;

g. means for biasing the operator tube to its second position;

h. means for biasing the valve closure means to its second position;

i. the piston means including a single rod partially disposed within a passage offset from the longitudinal bore;

j. a bearing assembly carried on the exterior of the operator tube between the piston means and the operator tube biasing means whereby the bearing assembly isolates the piston means from rotational forces generated by the operator tube biasing means;

k. the operator tube biasing means further comprising a first spring disposed on the exterior of the operator tube between a first shoulder on the operator tube and a shoulder on the interior of the housing means;

l. a load ring around the exterior of the operator tube intermediate the ends thereof;

m. one end of the rod securely engaged with the load ring;

n. the load ring abutting the bearing assembly;

o. means for transmitting longitudinal force from the piston means via the load ring to the operator tube; and p. the means for transmitting longitudinal force from the piston means via the load ring to the operator tube comprises a second shoulder on the exterior of the operator tube and a second spring between the second shoulder and the load ring.

7. The safety valve as defined in claim 6 wherein the piston means comprises:

a. a seal assembly disposed within the passageway and secured to the other end of the rod to form a slidable fluid barrier in the passageway;
b. seating surfaces at each end of the passageway to partially define limits for travel of the seal assembly therein; and
c. matching seating surfaces on the seal assembly to form a fluid barrier with the passageway when the seal assembly has reached the limit of its travel in either direction.

8. The safety valve as defined in claim 7 wherein the seal assembly comprises a plurality of piston rings to form a slidable fluid barrier with the passageway.

9. The safety valve as defined in claim 7 wherein the matching seating surfaces form metal-to-metal seals when engaged with each other.

10. A surface controlled subsurface tubing supported well safety valve comprising:
a. tubular housing means having a longitudinal bore therethrough and means on opposite ends for connecting the housing means in a well tubing string to form a portion thereof;
b. valve closure means mounted in the housing means to control fluid flow through the longitudinal bore;
c. the valve closure means having a first position which allows fluid flow through the longitudinal bore and a second position which blocks fluid flow therethrough;
d. means for biasing the valve closure means to its second position;
e. an operator tube in the housing means to shift the valve closure means from its second position to its first position;
f. the operator tube having first and second positions which correspond respectively to the first and second positions for the valve closure means;
g. means for biasing the operator tube to its second position comprising a first spring disposed on the exterior of the operator tube between a shoulder on the interior of the housing means and a first shoulder on the operator tube;
h. piston means for moving the operator tube and valve closure means to their first position;
i. the piston means including a single rod partially disposed within a passageway offset from the longitudinal bore;
j. a load ring disposed on the exterior of the operator tube between the first shoulder and the operator tube biasing means and one end of the single rod securely engaged with the load ring;
k. a bearing assembly carried on the exterior of the operator tube between the load ring and the operator tube biasing means whereby longitudinal force from the operator tube biasing means is transmitted via the bearing assembly and the load ring to the first shoulder on the operator tube; and
l. the load ring abutting the bearing assembly to apply force from the piston means to one side of the bearing assembly and the biasing means applying force to the other side of the bearing assembly whereby the bearing assembly isolates the piston means from rotational forces generated by the operator tube biasing means.

11. The safety valve as defined in claim 10 further comprising:
a. a second shoulder on the exterior of the operator tube; and
b. a second spring between the second shoulder and the load ring whereby the second shoulder and second spring comprise means for transmitting longitudinal force from the piston means via the load ring to the operator tube.

12. The safety valve as defined in claim 10 wherein the operator tube comprises:
a. at least two sections concentrically aligned with the longitudinal bore;
b. means for connecting adjacent sections to each other to facilitate longitudinal movement within the longitudinal bore; and
c. the connecting means including a barrier to restrict fluid flow between adjacent ends of the sections.

13. The safety valve as defined in claim 10 wherein the connecting means provides the second shoulder on the operator tube.

14. A surface controlled subsurface tubing supported well safety valve comprising:
a. tubular housing means having a longitudinal bore therethrough and means on opposite ends for connecting the housing means in a well tubing string to form a portion thereof;
b. valve closure means mounted in the housing means to control fluid flow through the longitudinal bore;
c. the valve closure means having a first position which allows fluid flow through the longitudinal bore and a second position which blocks fluid flow therethrough;
d. means for biasing the valve closure means to its second position;
e. an operator tube in the housing means to shift the valve closure means from its second position to its first position.,
f. the operator tube having first and second positions which correspond respectively to the first and second positions for the valve closure means;
g. means for biasing the operator tube to its second position comprising a first spring disposed on the exterior of the operator tube between a shoulder on the interior of the housing means and a first shoulder on the operator tube;
h. piston means for moving the operator tube and valve closure means to their first position;
i. the piston means including a single rod partially disposed within a passageway offset from the longitudinal bore;
j. a load ring around the exterior of the operator tube intermediate the ends thereof and one end of the single rod securely engaged with the load ring;
k. a bearing assembly carried on the exterior of the operator tube between the load ring and the operator tube biasing means;
l. the load ring abutting the bearing assembly to apply force from the piston means to one side of the bearing assembly and the biasing means applying force to the other side of the bearing assembly whereby the bearing assembly isolates the piston means from rotational forces generated by the operator tube biasing means;
m. the load ring disposed on the exterior of the operator tube between the first shoulder and the operator tube biasing means whereby longitudinal force from the operator tube biasing means is transmitted via the bearing assembly and the load ring to the first shoulder on the operator tube; and
n. means for transmitting longitudinal force from the piston means via the load ring to the operator tube comprising a second shoulder on the exterior of the operator tube and a second spring between the second shoulder and the load ring.

* * * * *